US009180379B2

(12) United States Patent
Choi

(10) Patent No.: US 9,180,379 B2
(45) Date of Patent: Nov. 10, 2015

(54) TOY TOP

(71) Applicant: Shin-Kyu Choi, Seoul (KR)

(72) Inventor: Shin-Kyu Choi, Seoul (KR)

( * ) Notice: Subject to any disclaimer, the term of this patent is extended or adjusted under 35 U.S.C. 154(b) by 0 days.

(21) Appl. No.: 14/377,145

(22) PCT Filed: Feb. 20, 2013

(86) PCT No.: PCT/KR2013/001302
§ 371 (c)(1),
(2) Date: Aug. 6, 2014

(87) PCT Pub. No.: WO2013/125834
PCT Pub. Date: Aug. 29, 2013

(65) Prior Publication Data

US 2015/0017872 A1 Jan. 15, 2015

(30) Foreign Application Priority Data

Feb. 20, 2012 (KR) ..... 10-2012-0016874

(51) Int. Cl.
*A63H 1/00* (2006.01)
*A63H 27/14* (2006.01)
*A63H 1/02* (2006.01)
*A63H 1/04* (2006.01)

(52) U.S. Cl.
CPC ... *A63H 1/02* (2013.01); *A63H 1/04* (2013.01)

(58) Field of Classification Search
CPC ..... A63H 1/00; A63H 27/14; F16H 55/283; E05Y 2900/55
USPC ..... 74/422, 89.17; 446/38–40, 256
See application file for complete search history.

(56) References Cited

U.S. PATENT DOCUMENTS

| | | | | |
|---|---|---|---|---|
| 4,732,569 | A * | 3/1988 | Hippely et al. | 446/430 |
| 6,221,409 | B1 * | 4/2001 | Bueno Ceresuela | 446/239 |
| 7,568,578 | B2 * | 8/2009 | Berman | 206/335 |
| 7,594,843 | B2 * | 9/2009 | Vetuskey | 446/39 |
| D637,661 | S * | 5/2011 | Horikoshi | D21/461 |
| 8,715,032 | B2 * | 5/2014 | Horikoshi et al. | 446/256 |

(Continued)

FOREIGN PATENT DOCUMENTS

| | | | | |
|---|---|---|---|---|
| JP | 09155067 | A * | 6/1997 | A63H 1/00 |
| JP | 11114231 | A * | 4/1999 | A63H 1/02 |

(Continued)

OTHER PUBLICATIONS

International Search Report issued Jul. 26, 2013 in corresponding International Patent Appl. No. PCT/KR2013/001302 (3 pages, in English).

*Primary Examiner* — Michael Dennis
*Assistant Examiner* — Urszula M Cegielnik
(74) *Attorney, Agent, or Firm* — NSIP Law

(57) ABSTRACT

A top which can facilitate the coupling of a winder is provided. The toy top comprises: a blade; a shaft of which one end is fixed to a lower portion of the blade; a pinion to be inserted and coupled to the middle of the shaft; and a shaft holder capable of accommodating the pinion-coupled shaft in a rotating manner, wherein the shaft holder comprises winder connectors (for rotating the pinion. Particularly, the winder connectors comprise: a cut portion for contacting a part of a first portion of a winder on a lateral side; and a guide groove for allowing a second portion extended from the first portion of the winder to be stopped at stepped protrusions inside the cut portion so as to prevent the second portion from being separated from the lateral side when a part of the first portion of the winder is contacted to a lateral side and then the winder is moved to the lateral side.

3 Claims, 10 Drawing Sheets

(56) References Cited

U.S. PATENT DOCUMENTS

| | | | | |
|---|---|---|---|---|
| 2008/0194173 | A1* | 8/2008 | Tiefel et al. | 446/236 |
| 2011/0256794 | A1* | 10/2011 | Horikoshi et al. | 446/259 |
| 2011/0306269 | A1 | 12/2011 | Horikoshi et al. | |

FOREIGN PATENT DOCUMENTS

| | | | |
|---|---|---|---|
| JP | 2002-219269 | A | 8/2002 |
| JP | 2009-118895 | A | 6/2009 |
| KR | 10-2010-0137171 | A | 12/2010 |

* cited by examiner

TOY TOP

CROSS REFERENCE TO RELATED APPLICATIONS

This application is a National Stage of International Application No. PCT/KR2013/001302, filed Feb. 20, 2013 and published as WO2013/125834 A1 on Aug. 29, 2013, which claims the benefit of Korean Patent Application No. 10-2012-0016874, filed on Feb. 20, 2012, the entire disclosures of which are incorporated herein by reference for all purposes.

TECHNICAL FIELD

The present invention relates to a toy top, and more particularly, to a toy top which can facilitate the coupling to a winder used to spin the top.

BACKGROUND

Generally, a top is a kind of a rotation amusement mechanism using its inertia, and the configuration of the top is disclosed in Korean Patent No. 1051847 issued to this inventor.

As shown in FIGS. 1 and 2, the conventional toy top 100 includes a blade 110, a shaft 123 fixed to the lower portion of the blade 110 at one end thereof, a pinion 122 fitted to the intermediate portion of the shaft 123, and a shaft holder 120 adapted to allow the shaft 123 to which the pinion 122 is fitted to be rotatably accommodated thereinto.

The shaft holder 120 includes a pinion housing 124 adapted to surround the pinion 122, a handle 127 disposed on the underside of the pinion housing 124 to support the lower end periphery of the shaft 123, and a rotary tip 126 disposed on the underside of the handle 127.

Bearings 28*a* and 28*b* are disposed on the pinion housing 124 and the handle 127 to make the shaft 123 gently rotate.

The pinion housing 124 has winder insertion holes 124*a* formed symmetrically to each other on both sides thereof so as to rotate the pinion 122 fitted to the shaft 123 in a clockwise or counterclockwise direction.

In the state wherein the handle 127 of the shaft holder 120 is held by a user's one hand, a winder 16 on which a rack gear portion 16*a* adapted to be engaged with the pinion 122 is formed is inserted into one side winder insertion hole 124*a*, and if the winder 16 is pulled by the other hand of the user and drawn from the winder insertion hole 124*a*, the blade 110 rotates. If the handle 127 is put on the floor in the state where the rotary force is applied to the blade 110, the top 100 becomes spin.

Under the above mentioned configuration of the conventional top 100, the winder insertion holes 124*a* are formed to insert the winder 16 thereinto, thus making it inconvenient to insert the winder 16 thereinto, and the rotary force is unnecessarily applied to the blade 110 when the winder 16 pushes up to a position where the winder 16 can pull after the insertion of the winder 16.

Further, the time needed to insert the winder 16 into the selected winder insertion hole 124*a* becomes disadvantageously extended.

DISCLOSURE

Accordingly, the present invention has been made in view of the above-mentioned problems occurring in the prior art, and it is an object of the present invention to provide a toy top that is capable of being rapidly coupled to a winder.

It is another object of the present invention to provide a toy top that can allow a winder just to come into contact with the lateral surface thereof and to pull inside any one of winder connectors, thus easily transmitting rotary power thereto, without having any insertion of the winder into any one of winder insertion holes.

To accomplish the above-mentioned objects, according to the present invention, there is provided a toy top including: a blade; a shaft fixed to the lower portion of the blade at one end thereof; a pinion fitted to the intermediate portion of the shaft; a shaft holder configured to allow the shaft to which the pinion is fitted to be rotatably accommodated thereinto; and winder connectors formed on both sides of the shaft holder to rotate the pinion.

According to the present invention, preferably, each winder connector includes: a cut portion adapted to allow a first portion of a winder to partially come into contact with the lateral side thereof; and a guide groove adapted to allow a second portion extended from the first portion of the winder to be locked onto stepped protrusions formed from the cut portion so as to prevent the second portion from being escaped from the lateral side thereof when the winder is moved to one side thereof in the state wherein the first portion of the winder partially comes into contact with the lateral side thereof.

According to the present invention, preferably, the first portion of the winder somewhat pulls to the inside of the cut portion of the winder connector in the state of being contacted with the cut portion, without having any fitting of the winder to the winder connector, so that the second portion on which the rack gear is formed is simply coupled to the guide groove of the selected winder connector.

According to the present invention, preferably, the first portion of the winder includes a first support rod having a lower thickness than the width of the cut portion of each winder connector and wings adapted to come into contact with both sides of the external surface of the cut portion, and the second portion of the winder includes a second support rod extended linearly from the first support rod and a rack gear having a higher thickness than the second support rod, the rack gear being formed in the opposite direction to the portion where the wings of the first portion are formed in such a manner as to be engaged with the pinion.

According to the present invention, preferably, the rack gear is locked on the stepped protrusions formed on the inner sides of the cut portion to prevent the second portion of the winder from being escaped from the lateral side of the winder connector.

According to the present invention, the toy top is configured wherein the first portion of the winder somewhat pulls to the inside of the cut portion of the winder connector in the state of being contacted with the cut portion, without having any fitting of the winder to the winder connector, and accordingly, the second portion on which the rack gear is formed is simply coupled to the guide groove of the winder connector, without any escape from the guide groove, thus avoiding the inconvenience caused by fitting the winder to the winder connector and preventing the rotary power from being unnecessarily applied to the blade when the winder is fitted.

Further, the toy top according to the present invention can transmit the rotary power to the blade at a rapider speed than the conventional top.

DETAILED DESCRIPTION OF DRAWINGS

Figure 1:
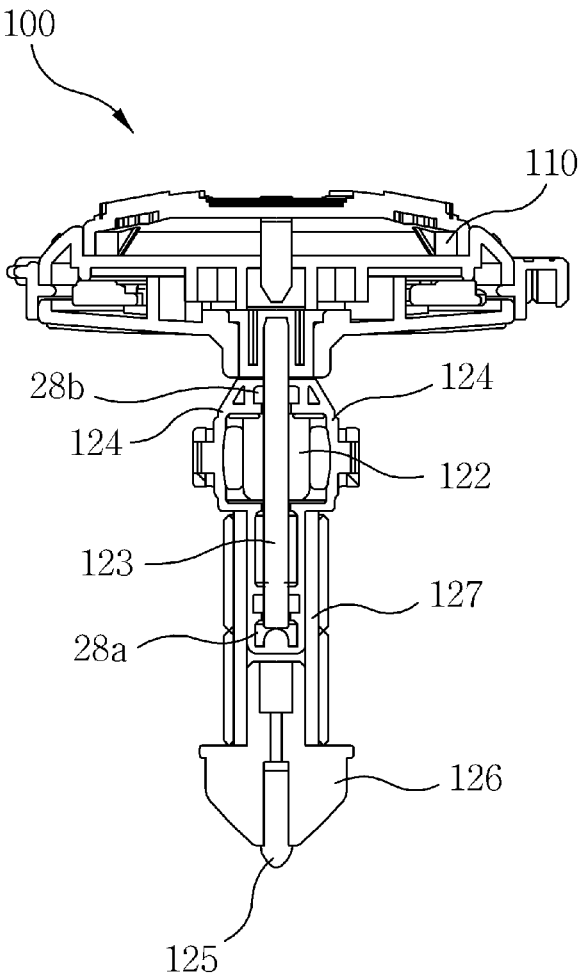
PRIOR ART Fig. 1
FIG. 1 is a sectional view showing a conventional toy top.
Figure 2:
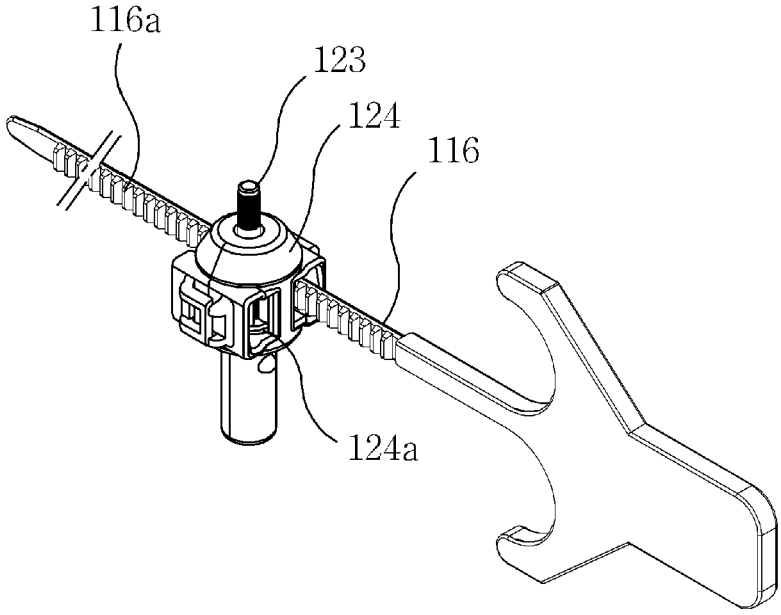
PRIOR ART Fig. 2
FIG. 2 is a perspective view showing the conventional toy top into which a winder is inserted.
Figure 3:
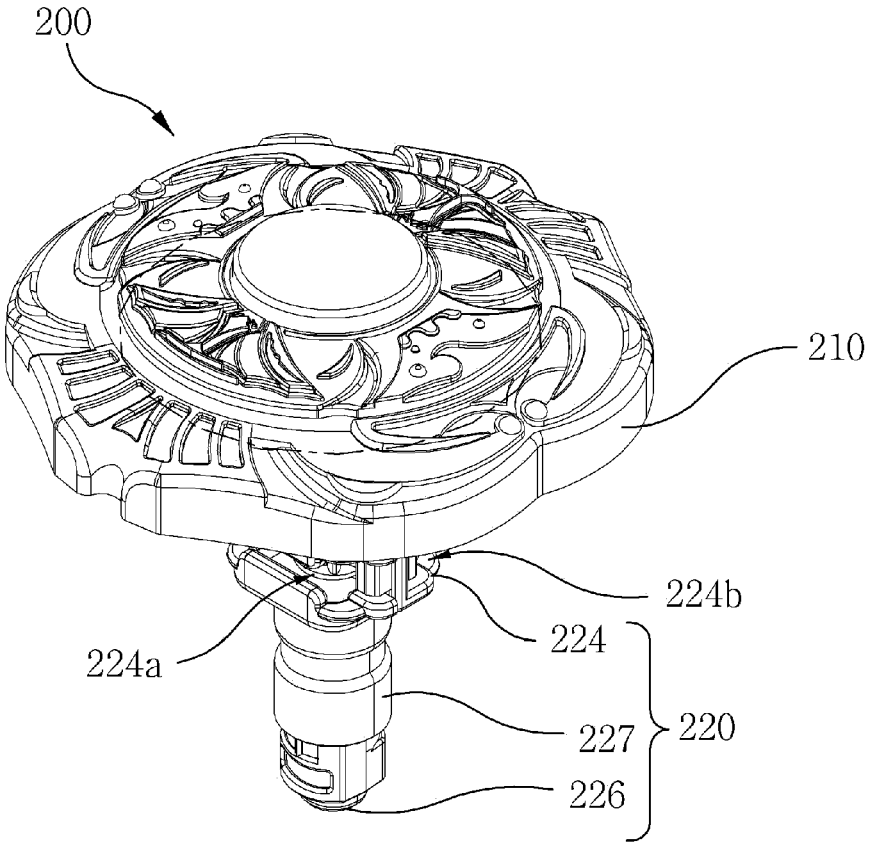
FIG. 3 is a perspective view showing a toy top according to the present invention.
Figure 4:
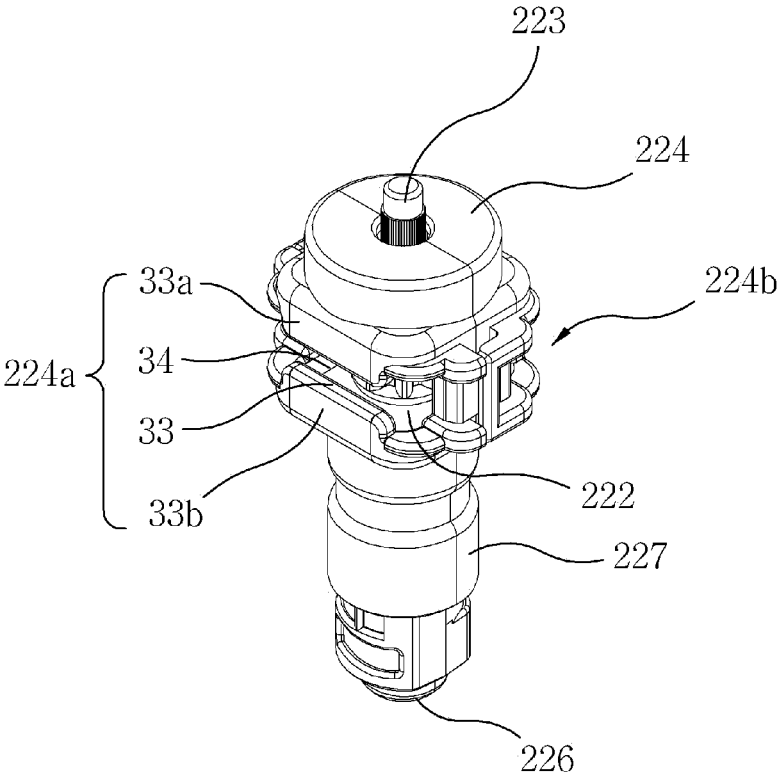
FIG. 4 is a perspective view showing the toy top of the present invention from which a blade is separated.
Figure 5:
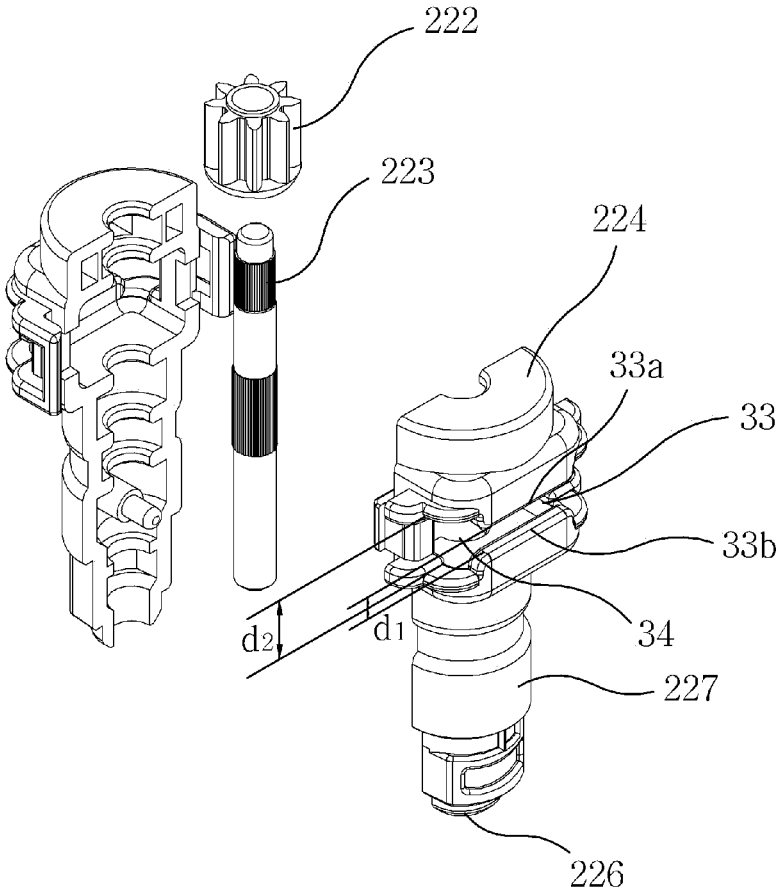
FIG. 5 is an exploded perspective view of FIG. 4.

Hereinafter, an explanation on the configuration and operational effects of a toy top according to the present invention will be in detail given with reference to the attached drawing. As shown in FIGS. 3 to 5, a toy top 200 according to the present invention includes a blade 210, a shaft 223 fixed to the lower portion of the blade 210 at one end thereof, and a pinion 222 fitted to the intermediate portion of the shaft 223.

The shaft 223 may be angular in section on the top end thereof or have a slip prevention stripe pattern formed thereon so as to be firmly fixed to the fixing portion of the blade 210, without idling.

A shaft holder 220 is disposed under the blade 210 to allow the shaft 223 to which the pinion 222 is fitted to be rotatably accommodated thereinto.

The shaft holder 220 includes a pinion housing 224 adapted to surround the pinion 222, a handle 227 disposed on the underside of the pinion housing 224 to support the lower end periphery of the shaft 223, and a rotary tip 226 disposed on the underside of the handle 227.

The parts of the shaft holder 220 are formed unitarily with each other by means of plastic injection, as shown in FIG. 5. Bearings (not shown) are disposed on the pinion housing 224 and the handle 227 to make the shaft 223 gently rotate.

Winder connectors 224*a* and 224*b* are formed symmetrically to each other on both sides of the pinion housing 224 so as to rotate the pinion 222.

In more detail, the pinion housing 224 has the winder connectors 224*a* and 224*b* formed symmetrically to each other on both sides thereof so as to rotate the pinion 222 fitted to the shaft 223 in a clockwise or counterclockwise direction.

Each of the winder connectors 224*a* and 224*b* includes a slit type cut portion 33 open on the lateral side thereof and a guide groove 34 formed inside the cut portion 33 through which a rack gear of a winder 116 as will be discussed later is passed. The cut portion 33 has stepped protrusions 33*a* and 33*b* formed protrudingly from the top and bottom portions thereof, and in this case, a width d2 of the guide groove 34 is larger than a width dl between the stepped protrusions 33*a* and 33*b*.

Figure 6:
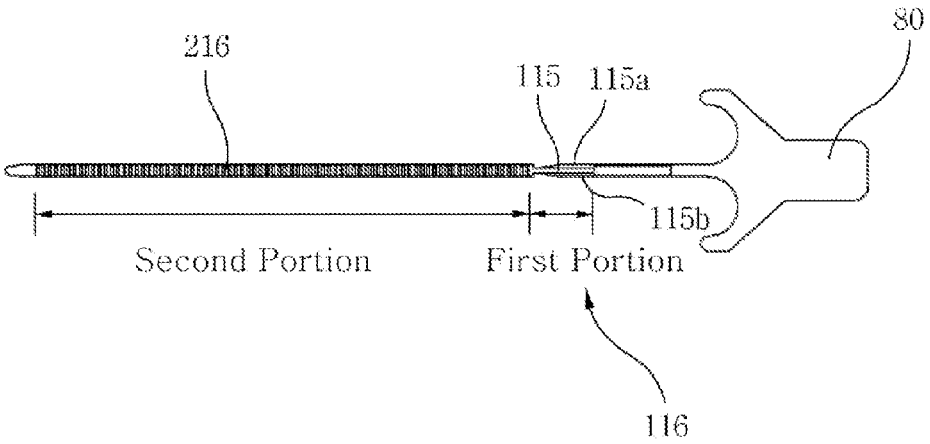
FIG. 6 is a front view showing a winder in the toy top according to the present invention.
Figure 7:
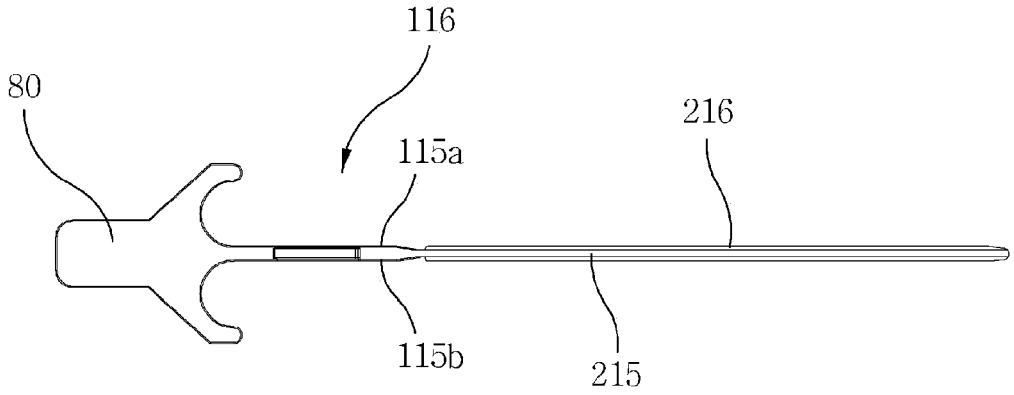
FIG. 7 is a rear view showing the winder in the toy top according to the present invention.
Figure 10:
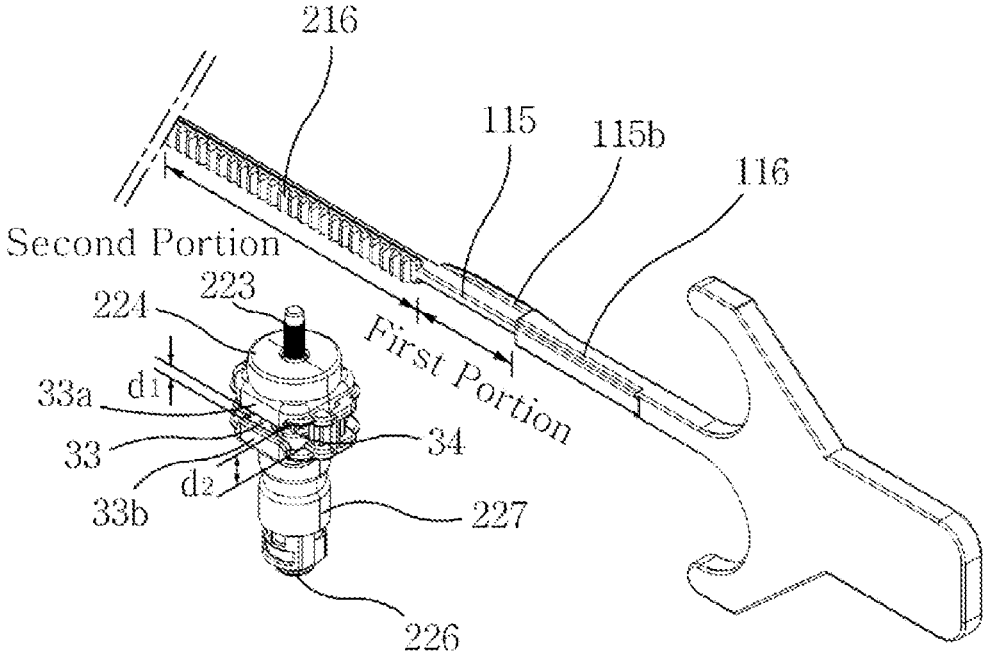
FIG. 10 is a perspective view showing the state of the toy top just before the winder comes into contact with the winder connector in the toy top according to the present invention.

On the other hand, as shown in FIGS. 6, 7 and 10, the winder 116, which is coupled to any one side winder connector, includes a first portion and a second portion. The first portion includes a first support rod 115 having a lower thickness than the width d1 of the cut portion 33 of each winder connector and wings 115*a* and 115*b* protruding in a wing shape from both side of the first support rod 115, and the second portion includes a second support rod 215 extended linearly from the first support rod 115 and a rack gear 216 having a higher thickness than the second support rod 215.

Particularly, the rack gear 216 is formed in the opposite direction to the portion where the wings 115*a* and 115*b* of the first portion are formed in such a manner as to be engaged with the pinion 222. The width of the rack gear 215 is larger than the width d1 of the cut portion 33 and smaller than the width d2 of the guide groove 34. Further, a handle 80 is formed on the outside of the first portion of the winder 116.

Figure 8:
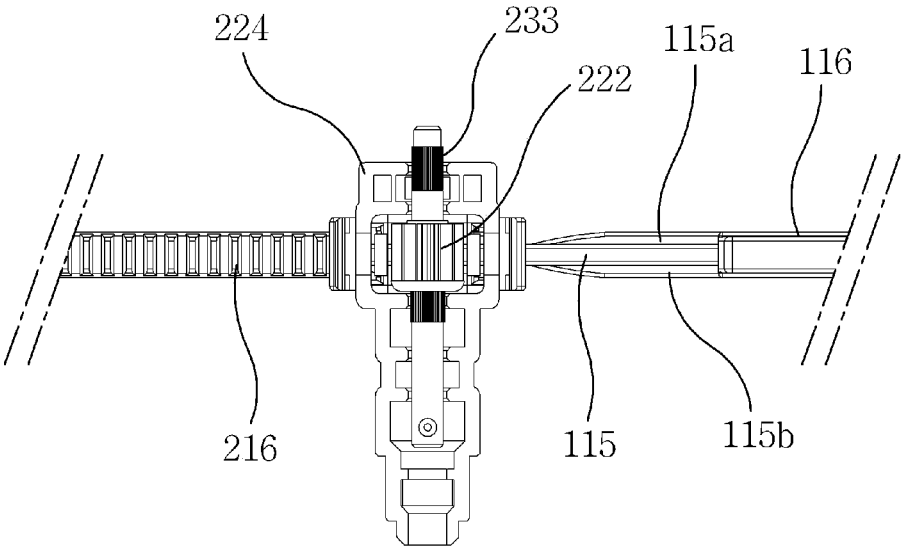
FIG. 8 is a sectional view showing the state wherein a second portion of the winder on which a rack gear is formed is coupled to a winder connector in the toy top according to the present invention.
Figure 9:
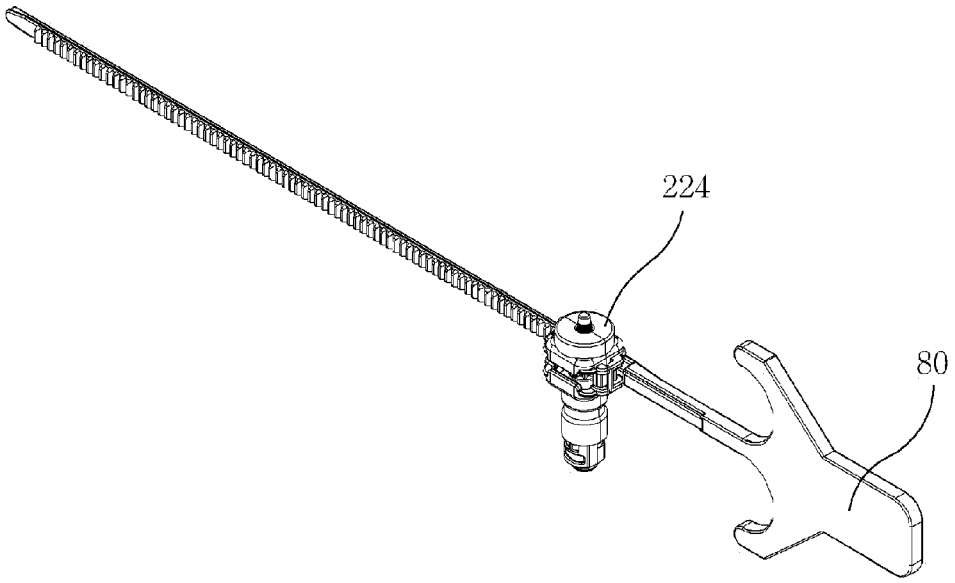
FIG. 9 is a perspective view showing the state wherein the second portion of the winder on which the rack gear is formed is coupled to the winder connector in the toy top according to the present invention.

Under the above configuration of the winder connectors 224*a* and 224*b* and the winder 116, if the first support rod 115 of the winder 116 comes into contact with one side cut portion 33 selected, only the first support rod 115 is fitted to the cut portion 33 in the state where the wings 115*a* and 115*b* are locked onto the external surfaces of the cut portion 33. In this state, if the handle 80 is somewhat moved, as shown in FIG. 8, the rack gear 216 formed on one surface of the second support rod 215 is locked onto the stepped protrusions 33*a* and 33*b* of the cut portion 33 and induced to the interior of the guide groove 34, without any escape from the lateral side of the winder connector. Of course, the first support rod 115 and the second support rod 215 have the same linear shape as each other in such a manner as to be passed into the width d1 of the cut portion 33.

For example, as shown in FIG. 10, the direction and position of the winder 116 are determined so as to allow the winder 116 to come into contact with one side winder connector 224*b*, and after that, if the winder 116 is moved to the winder connector 224*b* until the rack gear 216 of the second portion is locked onto the stepped protrusions 33*a* and 33*b* of the cut portion 33 and induced to the interior of the guide groove 34 in the state wherein the first portion of the winder 116 comes into contact with the cut portion 33, the coupling of the winder 116 to the winder connector 224*b* is simply completed. If the handle 80 pulls in the state wherein the coupling of the winder 116 has been finished, rotary power is transmitted to the pinion 222.

If the toy top 200 is put on the floor in the state wherein the blade 210 is rotated by the rotary force applied to the pinion 222, it is rotated by means of the centrifugal force generated from the rotating blade 210.

According to the present invention, the toy top has a structure wherein the coupling to the winder can be easily achieved.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

The invention claimed is:

1. A toy top comprising:

a blade;

a shaft fixed to a lower portion of the blade at one end thereof;

a pinion fitted coupled to an intermediate portion of the shaft;

a shaft holder configured to allow the shaft to which the pinion is fitted to be rotatably housed thereinto; and winder connectors formed on both sides of the shaft holder to rotate the pinion, wherein each winder connector comprises: a cut portion formed open at one side thereof to allow a portion of a first portion of a winder to be inserted into a lateral side thereof; and a guide groove formed thereon to allow a second portion extended from the first portion of the winder to be locked onto stepped protrusions formed inside the cut portion so as to prevent the second portion from being escaped from the lateral side thereof when the winder is moved to one side in a state wherein the portion of the first portion of the winder comes into contact with the lateral side thereof.

2. The toy top according to claim 1, wherein the first portion of the winder comprises: a first support rod having a lower thickness than a width of the cut portion of each winder connector; and wings adapted to come into contact with both sides of an external surface of the cut portion, and the second portion of the winder comprises: a second support rod extended linearly from the first support rod; and a rack gear having a higher thickness than the second support rod, the rack gear being formed in an opposite direction to the portion where the wings of the first portion are formed in such a manner as to be engaged with the pinion.

3. The toy top according to claim 1, wherein the rack gear is locked on the stepped protrusions formed inside the cut portion to prevent the second portion of the winder from being escaped from the lateral side of the winder connector.

* * * * *